US011982462B2

(12) United States Patent
Jung et al.

(10) Patent No.: US 11,982,462 B2
(45) Date of Patent: May 14, 2024

(54) AIR CONDITIONER

(71) Applicant: SAMSUNG ELECTRONICS CO., LTD., Suwon-si (KR)

(72) Inventors: Chang-Woo Jung, Suwon-si (KR); Sung Jae Kim, Suwon-si (KR); Jin-Gyun Kim, Suwon-si (KR); Young Tae Song, Suwon-si (KR); Hae Gyun Shin, Suwon-si (KR); Chang Sik Lee, Suwon-si (KR); Seo Young Cho, Suwon-si (KR); Sung Hyun Chun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 447 days.

(21) Appl. No.: 17/284,884

(22) PCT Filed: Oct. 8, 2019

(86) PCT No.: PCT/KR2019/013171
§ 371 (c)(1),
(2) Date: Apr. 13, 2021

(87) PCT Pub. No.: WO2020/080723
PCT Pub. Date: Apr. 23, 2020

(65) Prior Publication Data

US 2021/0389021 A1 Dec. 16, 2021

(30) Foreign Application Priority Data

Oct. 15, 2018 (KR) ..... 10-2018-0122576

(51) Int. Cl.
*F24F 13/22* (2006.01)
*F24F 13/20* (2006.01)
*F24F 13/30* (2006.01)

(52) U.S. Cl.
CPC ..... *F24F 13/222* (2013.01); *F24F 13/20* (2013.01); *F24F 13/30* (2013.01); *F24F 2013/221* (2013.01); *F24F 2013/227* (2013.01)

(58) Field of Classification Search
CPC ..... F24F 13/222; F24F 13/20; F24F 13/30; F24F 2013/221; F24F 2013/227; F24F 13/22; F24F 1/00
See application file for complete search history.

(56) References Cited

FOREIGN PATENT DOCUMENTS

EP 1 522 795 A1 4/2005
EP 2 518 418 A1 10/2012
(Continued)

OTHER PUBLICATIONS

KR-20170076011-A translation.*
(Continued)

*Primary Examiner* — Elizabeth J Martin
(74) *Attorney, Agent, or Firm* — STAAS & HALSEY LLP

(57) ABSTRACT

An air conditioner includes a cabinet including an inlet port and a frame including an outlet port and coupled to the cabinet. A heat exchanger is disposed between the cabinet and the frame to exchange heat with air introduced into the inlet port and discharged to the outlet port. A blocking member is configured to connect the frame and the heat exchanger to prevent air heat-exchanged with the heat exchanger from leaking into the cabinet. This structure inhibits dew from being generated on the cabinet.

14 Claims, 10 Drawing Sheets

(56) References Cited

FOREIGN PATENT DOCUMENTS

| | | | | |
|---|---|---|---|---|
| EP | 3 379 155 | A1 | | 9/2018 |
| JP | 2591041 | | | 3/1997 |
| JP | 2008-95970 | | | 4/2008 |
| JP | 2008-175456 | | | 7/2008 |
| KR | 2000-0014297 | | | 7/2000 |
| KR | 2001-0093370 | | | 10/2001 |
| KR | 2003-0013575 | | | 2/2003 |
| KR | 10-2004-0106050 | | | 12/2004 |
| KR | 10-0725744 | | | 6/2007 |
| KR | 10-2009-0011379 | | | 2/2009 |
| KR | 10-2010-0025671 | | | 3/2010 |
| KR | 20170076011 | A | * | 4/2017 |
| KR | 10-2017-0076011 | A | | 7/2017 |

OTHER PUBLICATIONS

Extended European Search Report dated Oct. 12, 2021 from European Application No. 19872392.6.
International Search Report dated Feb. 10 from International Application No. PCT/KR2019/013171, 5 pages.
Korean Office Action dated Apr. 25, 2023 for Korean Application No. 10-2018-0122576.
European Office Action dated Feb. 28, 2023 for European Application No. 19 872 392.6.

* cited by examiner

AIR CONDITIONER

CROSS-REFERENCE TO RELATED APPLICATIONS

This application is a U.S. National Stage Application, which claims the benefit under 35 U.S.C. § 371 of PCT International Patent Application No. PCT/KR2019/013171, filed Aug. 10, 2019 which claims the foreign priority benefit under 35 U.S.C. § 119 of Korean Patent Application No. 10-2018-0122576, filed Oct. 15, 2018, the contents of which are incorporated herein by reference.

TECHNICAL FIELD

The present disclosure relates to an air conditioner with an improved structure to prevent dew from being generated on a cabinet.

BACKGROUND ART

Air conditioners may be classified into a stand-type air conditioner installed on a floor of a room to cool or heat a relatively large indoor space, a wall-mounted air conditioner installed on a wall of a room to cool or heat a relatively small indoor space, and the like.

An air conditioner may include a refrigeration cycle device composed of a compressor, a condenser, a capillary tube, a heat exchanger, an electronic expansion valve, etc., and may cool or heat a room by inhaling and discharging air in the room.

An air conditioner may be an integrated type air conditioner in which an indoor unit and an outdoor unit are integrally provided, or a separate type air conditioner in which an indoor unit and an outdoor unit are separately provided. Recently, there is a trend that a separate type air conditioner is widely used.

In general, an outdoor unit of a separate type air conditioner may include a compressor, a condenser, and the like that generate a lot of noise, and an indoor unit of the separate type air conditioner may include a heat exchanger, a drain panel to collect and drain condensed water generated from the heat exchanger, a blowing fan, and the like.

When power is applied, indoor air may be sucked into a cabinet by the rotation of a blowing fan, the indoor air sucked into the inside of the cabinet by the blowing fan may be heat-exchanged by a heat exchanger and then discharged again through an outlet port by the blowing fan.

When an air conditioner is used exclusively for cooling, the heat exchanger may operate as an evaporator, the evaporator may lower the temperature of air sucked by absorbing heat from the surroundings through the evaporation of refrigerant.

In order to increase the heat exchange efficiency of an air conditioner, it is necessary to prevent the cold air whose temperature is lowered by the heat exchanger from leaking to the outside of the cabinet, and dew may be formed on the cabinet due to a temperature difference between the inside and outside of the cabinet.

In a case where an insulation material is attached to the cabinet to prevent dew from being formed on the cabinet, the assembly process of an air conditioner may be complicated, and the product cost of the air conditioner may increase.

DISCLOSURE

Technical Problem

The present disclosure is directed to providing an air conditioner with an improved structure to prevent cold air from leaking to the outside of a cabinet.

The present disclosure is directed to providing an air conditioner with an improved structure to prevent dew from being generated on a cabinet.

Technical Solution

An aspect of the present disclosure provides an air conditioner including a cabinet including an inlet port, a frame including an outlet port and coupled to the cabinet, a heat exchanger disposed between the cabinet and the frame to exchange heat with air introduced into the inlet port and discharged to the outlet port, and a blocking member configured to connect the frame and the heat exchanger to prevent air heat-exchanged with the heat exchanger from leaking into the cabinet.

The blocking member may be formed integrally with the frame.

The blocking member may extend from the frame toward the heat exchanger to be in contact with the heat exchanger.

The frame may include a discharge panel comprising a first outlet port, and a second outlet port provided adjacent to the discharge panel, and the blocking member may be configured to guide air heat-exchanged with the heat exchanger to the first outlet port and prevent the air heat-exchanged with the heat exchanger from flowing to the second outlet port.

The blocking member may have a length corresponding to a length of one side of the heat exchanger.

The air conditioner may further include a partition member disposed between the heat exchanger and the cabinet to partition a first flow path in which the heat exchanger is disposed and a second flow path together with the cabinet, wherein the blocking member may partition the first flow path and the partition member to prevent dew from being generated on the partition member.

The blocking member may constitute a receiving part disposed between the first flow path and the second flow path together with the partition member.

The blocking member may include a panel part provided such that dew is generated thereon, and a guide part extending from the panel part to guide the dew generated on the panel part.

The partition member may include a drain panel to collect condensed water generated in the heat exchanger, and the guide part may guide the dew formed on the panel part to the drain panel.

The partition member may include a receiving plate in which the dew guided along the guide part is received, and a rib provided on the receiving plate to prevent the dew received in the receiving plate from leaking to the outside of the receiving plate.

The rib may protrude from the receiving plate.

The guide part may be connected to the rib to guide the dew formed on the panel part to the receiving plate.

The rib may be formed integrally with the partition member.

The receiving plate may be disposed to be in communication with the drain panel.

The blocking member may be disposed such that dew is formed on one surface of the panel part facing the partition member and guided to the receiving plate.

Another aspect of the present disclosure provides an air conditioner including a cabinet including a first inlet port and a second inlet port, a frame including a first outlet port provided to discharge air introduced through the first inlet port and a second outlet port provided to discharge air introduced through the second inlet port, a flow path including a first flow path to communicate the first inlet port and the first outlet port and a second flow path to communicate the second inlet port and the second outlet port, a heat exchanger disposed in the first flow path, and a partition member disposed between the heat exchanger and the cabinet to partition the first flow path and the second flow path, wherein the frame includes a blocking member protruding toward the heat exchanger to prevent dew from being generated on the partition member due to a temperature difference between air flowing through the first flow path and air flowing through the second flow path.

The blocking member may be in contact with the heat exchanger to partition the first flow path and the second flow path.

The blocking member may constitute a receiving part disposed between the first flow path and the second flow path together with the partition member.

Another aspect of the present disclosure provides an air conditioner including a cabinet including an inlet port, a heat exchanger disposed inside the cabinet, a frame coupled to the cabinet and including a blocking member configured to prevent air introduced through the inlet port and heat-exchanged with the heat exchanger from leaking to the cabinet, and a partition member disposed between the cabinet and the frame and including a drain panel to collect condensed water generated in the heat exchanger and a rib to guide dew generated on the blocking member to the drain panel.

The blocking member and the rib may be in contact with each other.

Advantageous Effects

An air conditioner according to the present disclosure can prevent cold air from leaking to the outside of a cabinet by including a blocking member.

Further, the air conditioner according to the present disclosure can prevent dew from being generated on the cabinet by including the blocking member.

Further, the air conditioner according to the present disclosure can, through a drain panel, collect dew generated on the blocking member together with condensed water generated by a heat exchanger by including a guide member and a rib.

MODE OF THE DISCLOSURE

Figure 1:
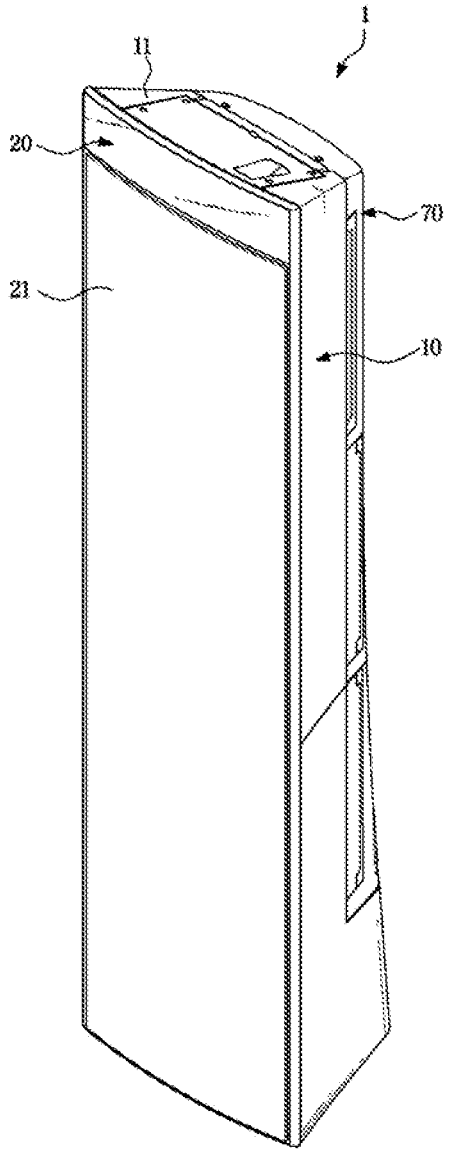
FIG. 1 is a perspective view of an air conditioner according to the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise.

The terms "comprises" and "has" are intended to indicate that there are features, numbers, steps, operations, elements, parts, or combinations thereof described in the specification.

Therefore, the above terms do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another.

For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "upper end" and "lower end" used in the following description are defined with reference to the drawings, and the shape and position of each component are not limited by these terms.

Hereinafter, an embodiment of the present disclosure will be described in detail with reference to the accompanying drawings.

A refrigeration cycle of an air conditioner is composed of a compressor, a condenser, an expansion valve, and an evaporator. A refrigerant undergoes a series of processes comprising of compression, condensation, expansion, and evaporation, and a high temperature air is heat exchanged with a low temperature refrigerant to become a low temperature air and supplied to a room.

The compressor compresses a refrigerant gas to a high temperature and high pressure and then discharges the high temperature and high pressure gas, and the discharged refrigerant gas is introduced into the condenser.

The condenser condenses the compressed refrigerant into a liquid phase and radiates heat to the surroundings through the condensation process.

The expansion valve expands a high temperature and high pressure liquid refrigerant condensed in the condenser into a low pressure liquid refrigerant.

The evaporator evaporates the refrigerant expanded in the expansion valve. The evaporator uses the latent heat of evaporation of a refrigerant to achieve a cooling effect by heat exchange with an object to be cooled, and returns a low temperature and low pressure refrigerant gas to the compressor.

Through this cycle, an air conditioner may control an air temperature of an indoor space.

An outdoor unit of an air conditioner refers to a device comprising of a compressor and an outdoor heat exchanger in a refrigeration cycle. An expansion valve may be disposed in either an indoor unit or the outdoor unit of the air conditioner, and an indoor heat exchange is disposed in the indoor unit of the air conditioner.

The present disclosure relates to an air conditioner to cool an indoor space, the outdoor heat exchanger functions as a condenser, and the indoor heat exchanger functions as an evaporator. Hereinafter, for convenience, an indoor unit including an indoor heat exchanger is referred to as an air conditioner, and an indoor heat exchanger is referred to as a heat exchanger.

Figure 2:
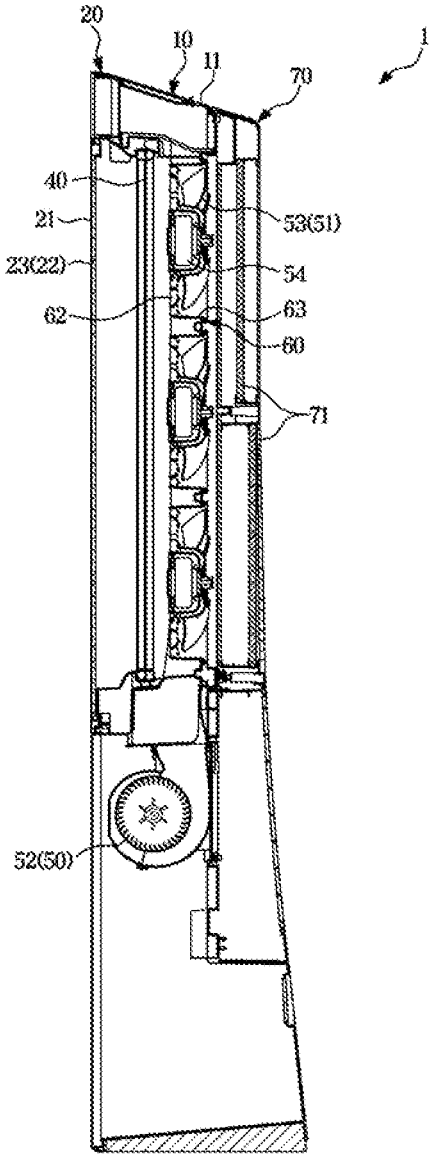
FIG. 2 is a cross-sectional view of the air conditioner according to the present disclosure.
Figure 3:
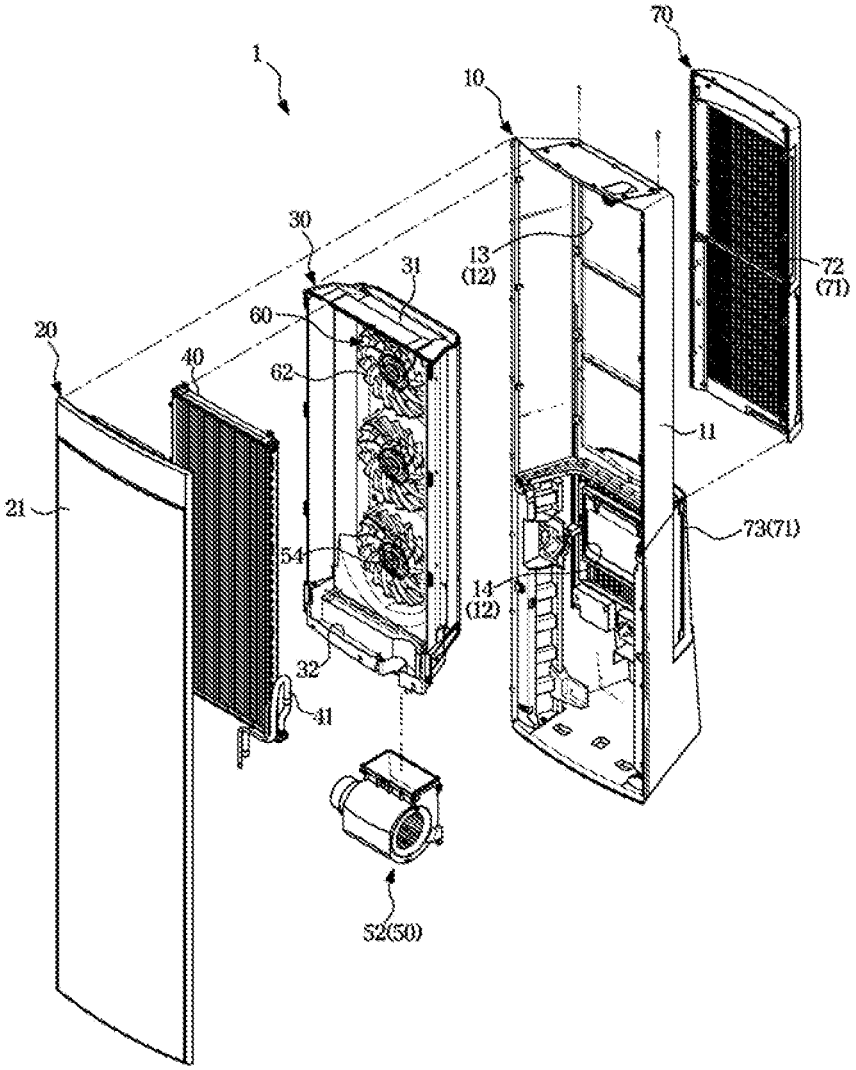
FIG. 3 is an exploded perspective view of the air conditioner according to the present disclosure.
Figure 4:
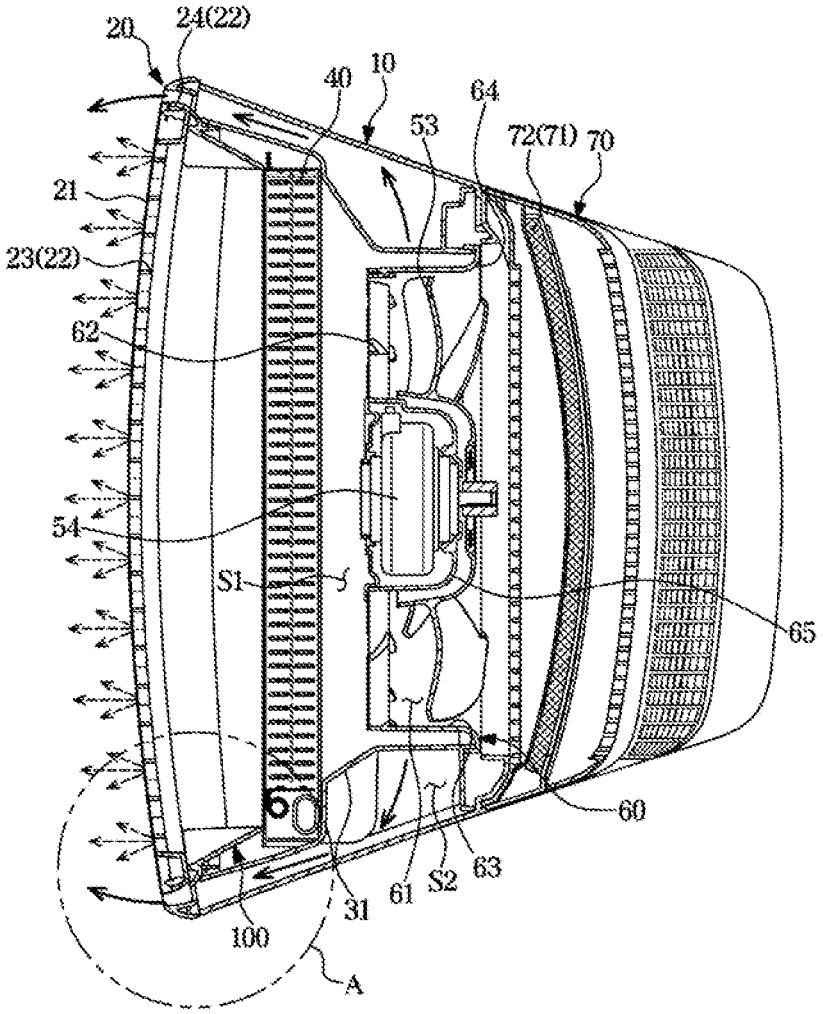
FIG. 4 is a cross-sectional view of the air conditioner according to the present disclosure.

FIG. 1 is a perspective view of an air conditioner according to the present disclosure. FIG. 2 is a cross-sectional view of the air conditioner according to the present disclosure. FIG. 3 is an exploded perspective view of the air conditioner according to the present disclosure. FIG. 4 is a cross-sectional view of the air conditioner according to the present disclosure.

As illustrated in FIGS. 1 to 4, an air conditioner 1 may include a cabinet 10 and a frame 20 coupled to the cabinet 10. The cabinet 10 may form a rear exterior of the air conditioner 1.

The air conditioner 1 according to the present disclosure is a stand type air conditioner that is installed on a floor, but is not limited thereto.

The frame 20 may form a front exterior of the air conditioner 1. The frame 20 may be coupled to the front of the cabinet 10.

The air conditioner 1 may include a heat exchanger 40 to exchange heat with air flowing into the cabinet 10, and a fan assembly 50 to circulate air into or out of the cabinet 10.

The frame 20 may include a discharge panel 21. The cabinet 10 may include a plurality of panels 11 to correspond to the discharge panel 21.

A outlet port 22 to discharge air passing through the inside of the air conditioner 1 may include a first outlet port 23 provided on the discharge panel 21, and a second outlet port 24 (see FIG. 4) provided adjacent to the first outlet port 23.

The first outlet port 23 may penetrate the discharge panel 21. The first outlet port 23 may have a fine size. The first outlet ports 23 may be uniformly distributed over the entire area of the discharge panel 21.

Air heat-exchanged by the heat exchanger 40 may be uniformly discharged to the outside at a low speed through the first outlet ports 23. An embodiment of the present disclosure illustrates that the first outlet port 23 is provided on the discharge panel 21 as an example.

However, the first outlet port 23 is not limited to being formed on the discharge panel 21. That is, another opening (not shown) having a larger size than the first outlet port 23 may be provided on the discharge panel 21.

The outlet port 22 may include an opening. The opening may be provided on the discharge panel 21 so that air heat-exchanged by the heat exchanger 40 is discharged to the outside without air resistance.

Because the first outlet port 23 has a size much smaller than the opening, air heat-exchanged by the heat exchanger 40 may be decelerated by the air resistance at the first outlet port 23 and uniformly discharged to the outside at a low speed. An embodiment of the present disclosure illustrates that the first outlet port 23 is formed on the discharge panel 21, but is not limited thereto.

The panel 11 of the cabinet 10 may include an inlet port 12. The inlet port 12 may be formed to penetrate the panel 11 provided on a rear surface of the cabinet 10. Air passed through a filter assembly 70 through the inlet port 12 may be introduced into the cabinet 10.

The inlet port 12 may include a first inlet port 13 and a second inlet port 14 disposed below the first inlet port 13. However, the present disclosure is not limited thereto.

The heat exchanger 40 is disposed inside the cabinet 10, and may be disposed on a movement path of air introduced from the rear of the cabinet 10 and proceeding forward.

The heat exchanger 40 may be disposed on a movement path of air from the fan assembly 50 to the first outlet port 23 of the discharge panel 21. The heat exchanger 40 may be disposed on a first flow path S1.

The heat exchanger 40 may be configured to absorb heat from air introduced into the cabinet 10 or to transfer heat to the air. A drain panel 32 may be provided below the heat exchanger 40 to collect moisture condensed in the heat exchanger 40.

The drain panel 32 may be connected to a drain hose 41 connected to the outside of the cabinet 10 to discharge condensed moisture to the outside of the cabinet 10.

The frame 20 may include a second outlet port 24. The second outlet port 24 may be formed on the left side and the right side of the discharge panel 21. The second outlet port 24 may be disposed adjacent to the discharge panel 21. The second outlet port 24 may extend along a vertical direction of the discharge panel 21.

The second outlet port 24 may have substantially the same length as a length of the discharge panel 21. Air that is not heat-exchanged inside the cabinet 10 may be discharged to the outside of the cabinet 10 through the second outlet port 24.

Air discharged from the second outlet port 24 may be mixed with air discharged through the first outlet port 23 of the discharge panel 21 and discharged to the outside. The fan assembly 50 may include a first fan assembly 51 and a second fan assembly 52.

The second fan assembly 52 may be disposed at a lower portion of the cabinet 10 and configured to flow external air in the air conditioner 1 to the second outlet port 24. When the first fan assembly 51 is disposed at an upper portion of the air conditioner 1, the second fan assembly 52 may be disposed at a lower portion of the air conditioner 1.

The filter assembly 70 may include a filter 71 having a first filter 72 and a second filter 73.

Air passed through the second filter 73 mounted on the rear surface of the cabinet 10 may flow to the second outlet port 24 by the second fan assembly 52. The air passed through the second filter 73 may flow through a second flow path S2 by the second fan assembly 52 and flow to the second outlet port 24.

The filter assembly 70 may be disposed in the rear of the cabinet 10. The filter assembly 70 may be provided to filter out foreign substances in air flowing into the cabinet 10.

The filter assembly 70 may be configured to be coupled to the panel 11 provided on the rear surface of the cabinet 10.

The first fan assembly 51 may include a fan 53 and a fan guard 60. The fan 53 may be configured to discharge external air in the cabinet 10 through the first outlet port 23 of the cabinet 10. The type of fan 53 is not limited.

The fan guard 60 may be configured such that the fan 53 is disposed. The fan 53 may be disposed inside the fan guard 60. The fan guard 60 may be formed in a shape of being recessed forward, and the fan 53 may be disposed in a space formed by the recessed shape.

The fan guard 60 may be configured to protect the fan 53 or guide air blown from the fan 53.

A flow path of air that is blown and flows by the first fan assembly 51 to be discharged to the first outlet port 23 of the discharge panel 21 may be referred to as the first flow path S1. A flow path of air that is blown and flows by the second fan assembly 52 to be discharged to the second outlet port 24 of the frame 20 may be referred to as the second flow path S2.

The first flow path S1 and the second flow path S2 may be partitioned. That is, the first flow path S1 and the second flow path S2 may be configured such that air flowing through the flow paths is not mixed inside the cabinet 10.

The air conditioner 1 may include a partition member 30. The partition member 30 may be configured to partition the first flow path S1 and the second flow path S2 within the cabinet 10. The partition member 30 may be disposed inside the cabinet 10.

The partition member 30 may be configured to be detachable from the cabinet 10. The partition member 30 may be mounted on the cabinet 10 to be surrounded by the panel 11 of the cabinet 10.

The partition member 30 may be configured to be substantially recessed toward the rear. The partition member 30 may be configured such that the first flow path S1 is formed on an inner surface thereof and the second flow path S2 is formed on an outer surface thereof.

The partition member 30 is coupled to the cabinet 10, and a rear surface of the partition member 30 may be coupled to cover at least a portion of the first inlet port 13 of the panel 11 provided on the rear surface of the cabinet 10.

The partition member 30 may include a partition panel 31 provided to correspond to the panel 11 of the cabinet 10. The fan guard 60 may be disposed on the partition member 30. The drain panel 32 may be disposed at a lower portion of the partition member 30. The drain panel 32 may be integrally formed with the partition member 30.

The first fan assembly 51 may be provided to be exposed toward the rear of the cabinet 10. The first fan assembly 51 may be coupled to the panel 11 provided on the rear side of the cabinet 10. The first fan assembly 51 may be configured to be separated from the cabinet 10 rearward.

The fan 53 may be exposed toward the rear of the cabinet 10. Because the filter assembly 70 is configured to cover the rear of the cabinet 10, when the filter assembly 70 is separated from the cabinet 10, the fan 53 may be in a detachable state.

The fan 53 may be separated toward the rear of the cabinet 10 when the combination with a fan motor 54 is released. The at least one fan 53 may be provided. In an embodiment of the present disclosure, the three fans 53 may be arranged to be spaced apart in the vertical direction. However, the arrangement and number of the fans 53 are not limited thereto.

The fan guard 60 may be configured to be coupled to the cabinet 10. The fan guard 60 may be configured to be coupled to the panel 11 provided on the rear surface of the cabinet 10.

The panel 11 and the fan guard 60 provided on the rear surface of the cabinet 10 may partition a space in which the heat exchanger 40 is disposed in the front thereof and a space in which the filter assembly 70 is disposed in the rear thereof.

The fan guard 60 is formed in a cylindrical shape, and one side thereof may be open. The fan guard 60 may include an arrangement space 61 in which the fan 53 is disposed. The fan 52 may be separated from or combined into the arrangement space 61. The arrangement space 61 of the fan guard 60 may be configured to be open toward the rear of the cabinet 10.

The at least one fan guard 60 may be provided to correspond to the provided at least one fan 53. In an embodiment of the present disclosure, a plurality of the fan guards 60 may also be disposed to be spaced apart in the vertical direction to correspond to the plurality of fans 53 spaced apart in the vertical direction.

The filter assembly 70 may be configured to cover the first fan assembly 51. The filter assembly 70 may be configured to cover the first fan assembly 51 exposed toward the rear of the cabinet 10.

The filter assembly 70 may be detachably coupled to the cabinet 10 as one assembly. The filter assembly 70 may be coupled to the panel 11 provided on the rear surface of the cabinet 10.

A plurality of the filter assemblies 70 may be provided to cover a plurality of the fan assemblies 50, respectively. In an embodiment of the present disclosure, in consideration of an arrangement direction of the plurality of fan assemblies 50, the filter assembly 70 may be configured to extend long in the vertical direction to cover the plurality of fan assemblies 50.

The fan guard 60 may include a fan grill 62 and a duct 63. The fan grill 62 may be provided to guide air flowing by the fan 53. The fan grill 62 may be provided in the front of the fan 53 to guide air blown by the fan 53.

The fan grill 62 may be configured such that a front surface thereof faces the heat exchanger 40 and a rear surface thereof faces the fan 53. The fan grill 62 may be configured to partition the heat exchanger 40 and the fan 53.

When viewed from the rear of the cabinet 10, the pan grill 62 may be formed to be bent clockwise from the center thereof. The fan 53 may be formed such that wings thereof are bent counterclockwise from the center thereof.

As the fan grill 62 and the wings of the fan 53 are formed to be bent in opposite directions, air blown from the fan 53 may flow more in a straight line while passing through the fan grill 62.

The duct 63 may be configured to surround the fan 53. The fan 53 is disposed inside the duct 63 so that the duct 63 may guide air flowing by the fan 53.

The fan guard 60 may include a shroud 64. The shroud 64 prevents air from being introduced between the panel 11 provided on the rear surface of the cabinet 10 and the fan guard 60, thereby increasing the heat exchange efficiency and preventing a decrease in the air volume of the fan 53.

The shroud 64 may be disposed along the periphery of the duct 63. The shroud 64 may be disposed to be in contact with a rear surface of the panel 11 provided on the rear surface of the cabinet 10.

The fan guard 60 may include a motor seating part 65. The motor seating part 65 may be located in a central portion of the pan grill 62. The motor seating part 65 is configured to protrude rearward from the pan grill 62, and the front surface of the pan grill 62 may be formed to be recessed from the front.

The motor seating part 65 may be configured such that a front surface thereof is recessed from the front and a rear surface thereof protrudes toward the rear. The fan motor 54 may be disposed in a recessed space of the motor seating part 65.

The air conditioner 1 according to the present disclosure may include a blocking member 100 connecting the frame 20 and the heat exchanger 40 to prevent air heat-exchanged with the heat exchanger 40 from leaking into the cabinet 10. Hereinafter, the blocking member 100 will be described in detail.

Figure 5:
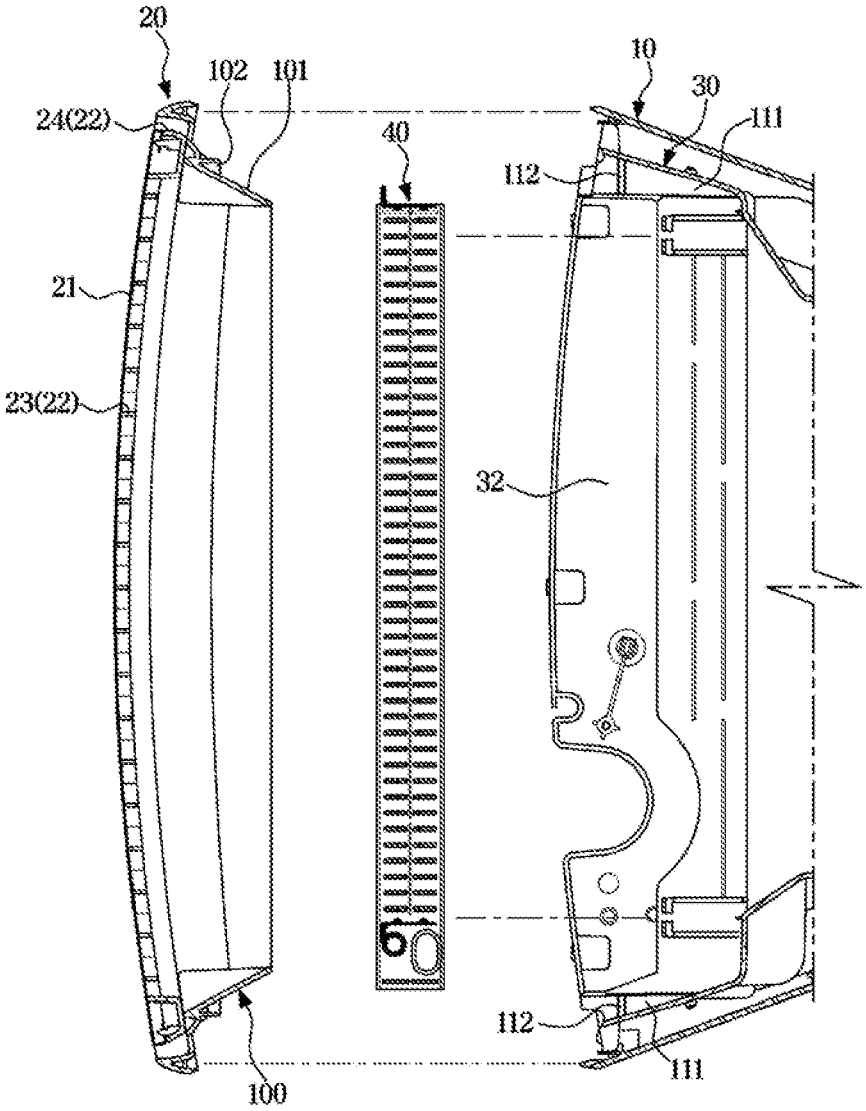
FIG. 5 is an exploded cross-sectional view of a frame, a heat exchanger, and a partition member in the air conditioner according to the present disclosure.
Figure 6:
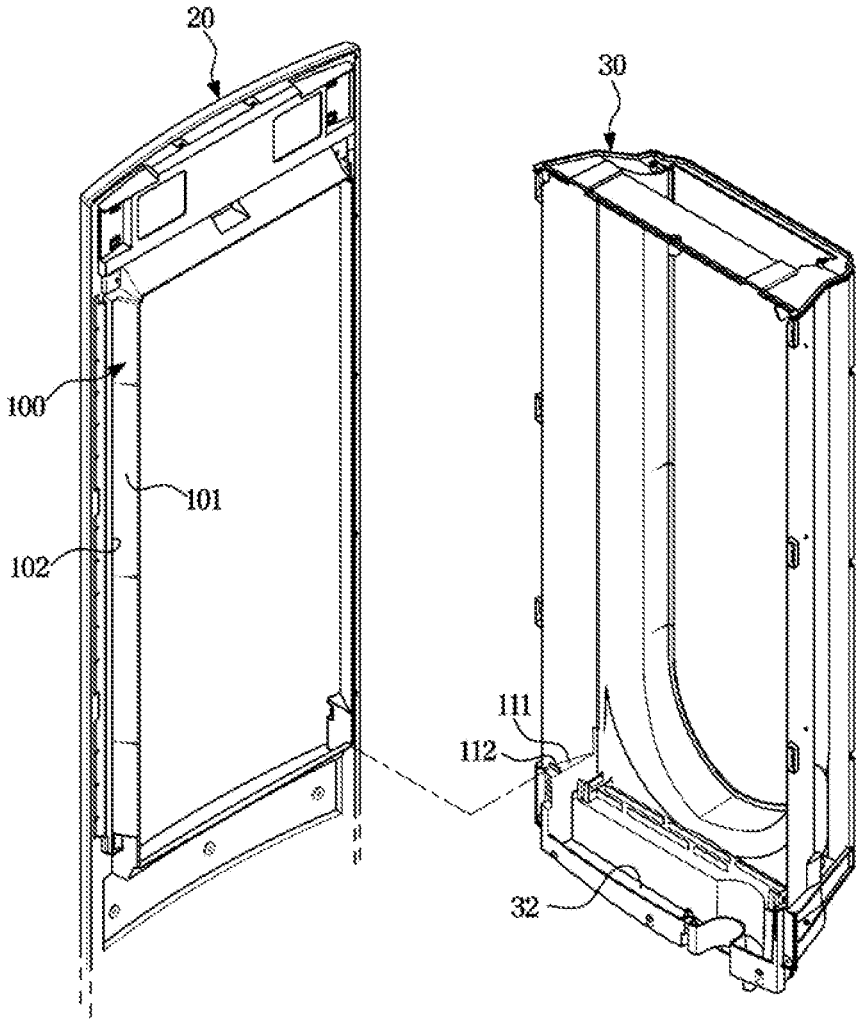
FIG. 6 is an exploded perspective view of the frame and the partition member in the air conditioner according to the present disclosure.
Figure 7:
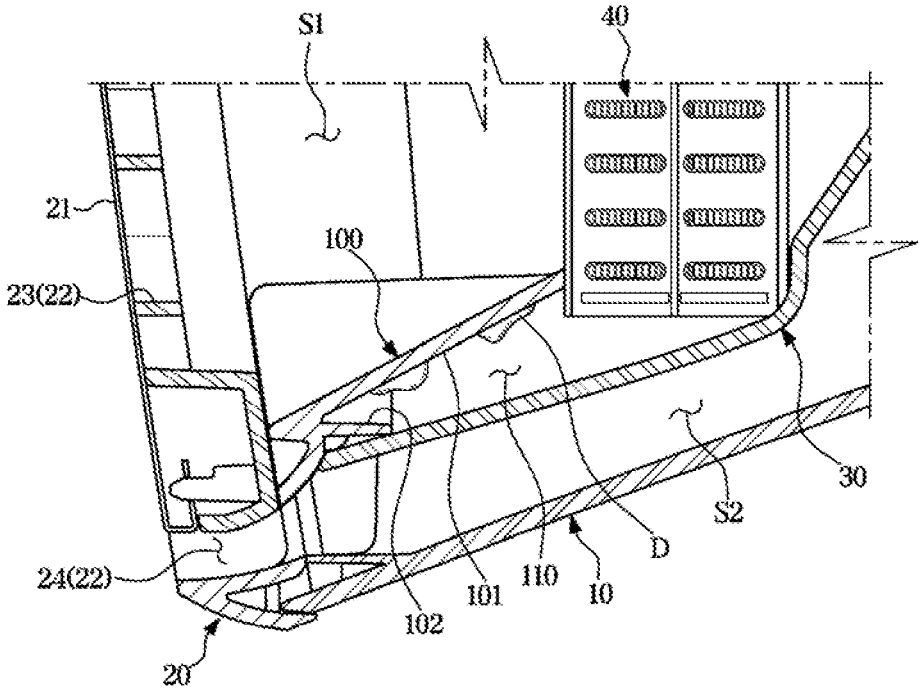
FIG. 7 is an enlarged view of part A of the air conditioner according to the present disclosure in FIG. 4.

FIG. 5 is an exploded cross-sectional view of a frame, a heat exchanger, and a partition member in the air conditioner according to the present disclosure. FIG. 6 is an exploded perspective view of the frame and the partition member in the air conditioner according to the present disclosure. FIG. 7 is an enlarged view of part A of the air conditioner according to the present disclosure in FIG. 4.

As illustrated in FIGS. 5 to 7, the blocking member 100 may extend from the frame 20 toward the heat exchanger 40 to be in contact with the heat exchanger 40.

Generally, when an air conditioner cools indoor air, dew may be formed on an outer surface of the cabinet of the air conditioner due to a temperature difference between air inside the air conditioner whose temperature has decreased by exchanging heat with the heat exchanger and the indoor air.

When an insulation material is attached to the cabinet to prevent dew from being formed on the cabinet, the assembly process of an air conditioner may be complicated, and the product cost of the air conditioner may increase.

On the other hand, as in the case of the air conditioner 1 (see FIG. 3) of the present disclosure, when the first flow path S1 and the second flow path S2 in which the heat exchanger 40 is disposed are provided, and the partition member 30 is provided between the cabinet 10 and the frame 20 to partition the first flow path S1 and the second flow path S2, dew D generated due to the temperature difference between air flowing through the first flow path S1 and air flowing through the second flow path S2 may be formed on the outer surface of the partition member 30, not on the cabinet 10.

The dew D formed on the outer surface of the partition member 30 may flow into electronic components inside the air conditioner 1 and cause a failure of the air conditioner 1.

To prevent this, the air conditioner 1 according to the present disclosure includes the blocking member 100 connecting the frame 20 and the heat exchanger 40 so that the dew D generated due to the temperature difference between air flowing through the first flow path S1 and air flowing through the second flow path S2 may be formed on an outer surface of the blocking member 100, not on the partition member 30.

The blocking member 100 may partition the first flow path S1 and the partition member 30 to prevent the dew D from being formed on the partition member 30.

Therefore, the air conditioner 1 according to the present disclosure may minimize the insulation material attached to prevent air whose temperature is lowered by exchanging heat with the heat exchanger 40 from leaking to the outside of the cabinet 10, so that the assembly process may be simplified and the material cost may be reduced.

The blocking member 100 may be integrally formed with the frame 20. The blocking member 100 may be injection-molded integrally with the frame 20.

The blocking member 100 may guide air heat-exchanged with the heat exchanger 40 to the first outlet port 23 and may prevent the air heat-exchanged with the heat exchanger 40 from flowing to the second outlet port 24.

Two of the blocking members 100 may be provided to correspond to opposite sides of the frame 20. The blocking member 100 may have a length corresponding to a length of one side of the heat exchanger 40.

The heat exchanger 40 may have a substantially rectangular shape, and the blocking member 100 may have a length corresponding to a length of a long side of the heat exchanger 40. That is, the blocking member 100 may be disposed to be in contact with opposite sides of the heat exchanger 40 along a longitudinal direction.

The blocking member 100 may constitute a receiving part 110 disposed between the first flow path S1 and the second flow path S2 together with the partition member 30. The receiving part 110 may be formed by being enclosed by the blocking member 100, the partition member 30, and the heat exchanger 40. Air introduced through the inlet port 12 (see FIG. 3) may not be introduced into the receiving part 110.

The blocking member 100 may be enclosed by the partition panel 31 forming a side surface of the partition member 30.

The dew D generated due to the temperature difference between air flowing through the first flow path S1 and air flowing through the second flow path S2 may be formed in the receiving part 110. The dew D may be formed on one surface of the blocking member 100 facing the partition member 30. The dew D may be formed on the outer surface of the blocking member 100.

The blocking member 100 may include a panel part 101 provided to be formed the dew D, and a guide part 102 extending from the panel part 101 to guide the dew D formed on the panel part 101.

The panel part 101 and the guide part 102 may be integrally formed. The guide part 102 may extend outward from the panel part 101. The guide part 102 may be disposed inside the receiving part 110. A shape of the guide part 102 may be variously formed within the limit of guiding the dew D formed on the panel part 101.

The partition member 30 may include a receiving plate 111 in which the dew D guided along the guide part 102 is received, and a rib 112 provided on the receiving plate 111 to prevent the dew D received in the receiving plate 111 from leaking to the outside of the receiving plate 111.

The receiving plate 111 may be provided at a lower portion of the partition member 30. The receiving plate 111 may form a portion of a bottom surface of the receiving part 110. The receiving plate 111 may be disposed above the drain panel 32.

The rib 112 may protrude from the receiving plate 111. The rib 112 may protrude upward from the receiving plate 111. The rib 112 may prevent the dew D received in the receiving plate 111 from leaking to the front of the receiving plate 111.

The receiving plate 111 and the rib 112 may be integrally formed with the partition member 30. The receiving plate 111 and the rib 112 may be injection-molded integrally with the partition member 30.

The rib 112 may be connected to the guide part 102 provided to guide the dew D formed on the panel part 101 to the receiving plate 111. The rib 112 may be in contact with the guide part 102. The guide part 102 may be disposed above the rib 112.

The two receiving plates 111 and ribs 112 may be disposed on opposite sides of the partition member 30 to correspond to the blocking member 100. The receiving plates 111 and the ribs 112 provided on the opposite sides of the partition member 30 may be asymmetric with each other. However, the present disclosure is not limited thereto. The rib 112 may be disposed in the front of the heat exchanger 40.

The guide part 102 and the rib 112 may guide the dew D, which is formed on the panel part 101 and received in the receiving plate 111, to the drain panel 32. The receiving plate 111 may be disposed to be in communication with the drain panel 32.

A portion of the bottom surface of the receiving part 110 may be covered by the receiving plate 111, and the dew D received in the receiving plate 111 through the other portion of the bottom surface of the receiving part 110, which is not covered by the receiving plate 111, may flow to the drain panel 32 by gravity.

Hereinafter, a process in which the dew D formed inside the air conditioner 1 according to the present disclosure is collected and drained through the drain panel 32 will be described in detail.

Figure 8:
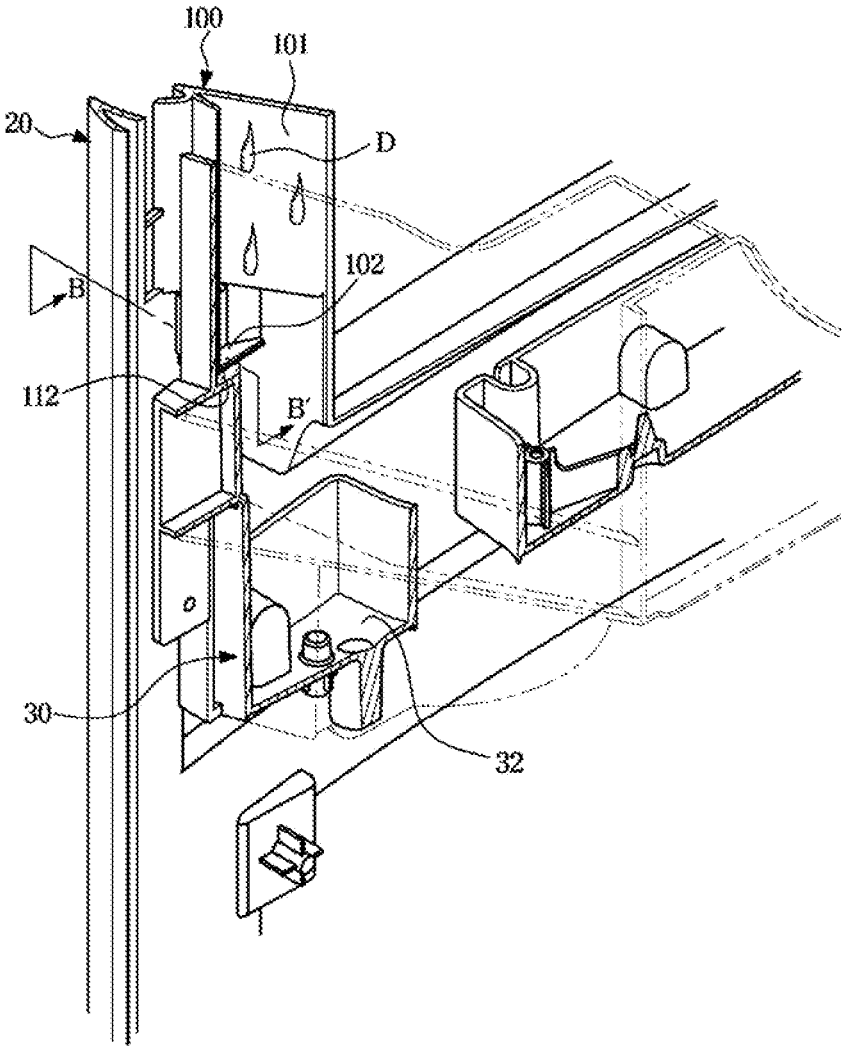
FIG. 8 is an enlarged view of a blocking member and a drain panel in the air conditioner according to the present disclosure.
Figure 9:
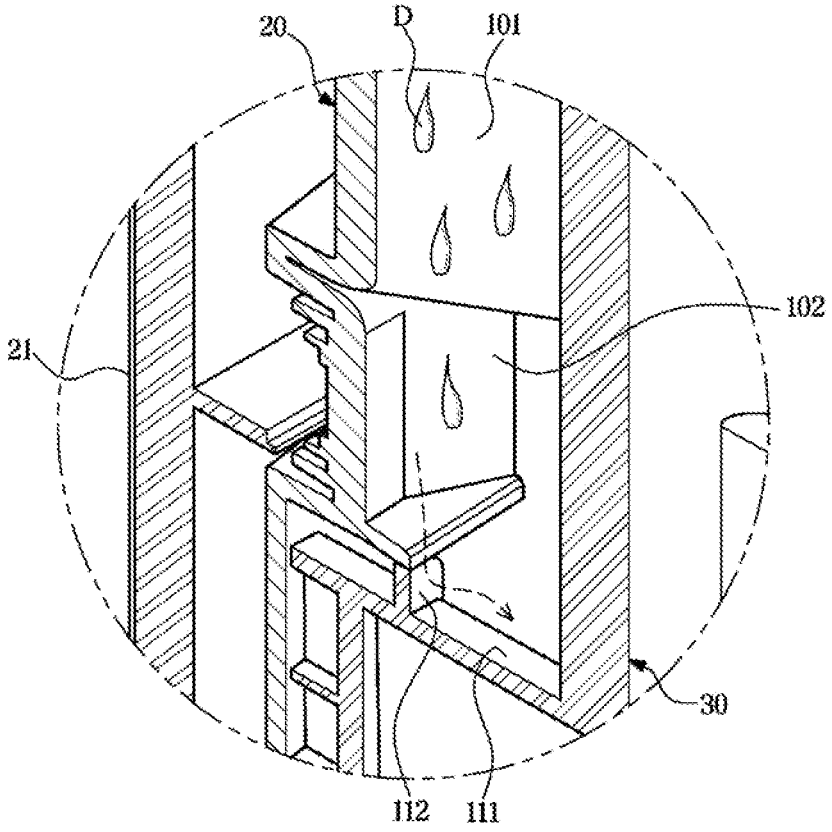
FIG. 9 is an enlarged view taken along line B-B' of the air conditioner according to the present disclosure in FIG. 8.
Figure 10:
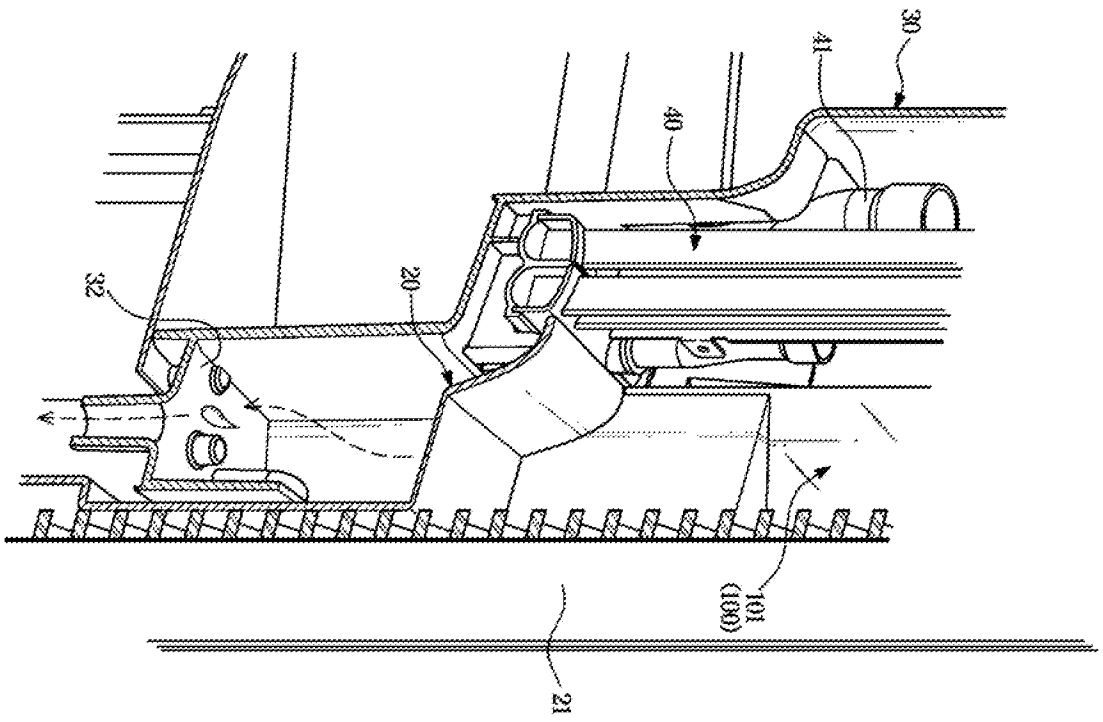
FIG. 10 is an enlarged view of the drain panel in the air conditioner according to the present disclosure.

FIG. 8 is an enlarged view of a blocking member and a drain panel in the air conditioner according to the present disclosure. FIG. 9 is an enlarged view taken along line B-B' of the air conditioner according to the present disclosure in FIG. 8. FIG. 10 is an enlarged view of the drain panel in the air conditioner according to the present disclosure.

As illustrated in FIGS. 8 to 10, the air conditioner 1 (see FIG. 3) according to the present disclosure includes the blocking member 100, so that air flowing through the first flow path 51 (see FIG. 7) whose temperature is lowered by heat exchange with the heat exchanger 40 may be prevented from leaking into the second flow path S2 (see FIG. 7) and the receiving part 110 (see FIG. 7). Accordingly, the cooling efficiency of the air conditioner 1 may be improved.

As the first flow path 51, the receiving part 110, and the second flow path S2 are partitioned by the blocking member 100 and the partition member 30, the dew D generated due to the temperature difference between air flowing through the first flow path S1 in which the heat exchanger 40 is disposed and air flowing through the second flow path S2 may be formed inside the receiving part 110.

The dew D generated due to the temperature difference between air flowing through the first flow path S1 in which the heat exchanger 40 is disposed and air flowing through the second flow path S2 may be formed on the outer surface of the blocking member 100 partitioning the first flow path S1 and the receiving part 110.

Therefore, the air conditioner 1 according to the present disclosure may be configured such that dew is formed on the outer surface of the blocking member 100 integrally formed with the frame 20, without the addition of a separate structure provided such that the dew D generated inside the air conditioner 1 is formed.

Because the blocking member 100 is disposed inside the partition panel 31 (see FIG. 3) provided on a side of the partition member 30, the blocking member 100 may be disposed further inside than a side edge of the drain panel 32 integrally formed with the partition member 30 and disposed at a lower portion of the partition member 30.

Therefore, unlike the case where the dew D is formed on the outer surface of the partition member 30, in the case where the dew D is formed on the outer surface of the blocking member 100 as in the present disclosure, the dew D may be directly guided to and collected in the drain panel 32, without increasing the width or size of the drain panel 32 or adding a separate structure such as a dew-receiving panel, in order to collect the dew D.

The dew D formed on the panel part 101 of the blocking member 100 may flow downward by gravity, and in the process of flowing the dew D, the dew D may be guided to the receiving plate 111 by the guide part 102 without leakage to the outside of the receiving part 110.

The dew D guided to and received in the receiving plate 111 may not leak to the outside of the receiving part 110 by the rib 112, may be received in the receiving plate 111, and may flow to the drain panel 32, which is in communication with the receiving plate 111, by gravity.

The dew D collected in the drain panel 32 may be drained to the outside of the air conditioner 1 through the drain hose 41 together with condensed water generated in the heat exchanger 40.

Therefore, in the air conditioner 1 according to the present disclosure, without adding a separate structure for collecting and draining the dew D generated inside the air conditioner 1, the dew D generated inside the air conditioner 1 may also be collected and drained through the drain panel 32 provided to collect and drain condensed water generated in the heat exchanger 40.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

The invention claimed is:

1. An air conditioner comprising:

a cabinet comprising an inlet port;

a frame comprising an outlet port and coupled to the cabinet;

a heat exchanger disposed between the cabinet and the frame to exchange heat with air introduced into the inlet port and discharged to the outlet port;

a partition member disposed between the heat exchanger and the cabinet to partition a first flow path through which heat-exchanged air flows and discharges to the first outlet port, and a second flow path through which the heat-exchanged air flows through and discharges to the second outlet port; and a blocking member configured to connect the frame and the heat exchanger to prevent the heat-exchanged air from leaking into the cabinet, wherein the blocking member partitions the first flow path and the partition member to prevent dew from being generated on the partition member.

2. The air conditioner according to claim 1, wherein the blocking member is formed integrally with the frame.

3. The air conditioner according to claim 1, wherein the blocking member extends from the frame toward the heat exchanger to be in contact with the heat exchanger.

4. The air conditioner according to claim 1, wherein the blocking member has a length corresponding to a length of one side of the heat exchanger.

5. The air conditioner according to claim 1, wherein the blocking member comprises a receiving part disposed between the first flow path and the second flow path together with the partition member.

6. The air conditioner according to claim 1, wherein the blocking member comprises a panel part provided such that dew is generated thereon, and a guide part extending from the panel part to guide the dew generated on the panel part.

7. The air conditioner according to claim 6, wherein the partition member comprises a drain panel to collect condensed water generated in the heat exchanger, and the guide part guides the dew formed on the panel part to the drain panel.

8. The air conditioner according to claim 7, wherein the partition member comprises a receiving plate in which the dew guided along the guide part is received, and a rib provided on the receiving plate to prevent the dew received in the receiving plate from leaking to outside of the receiving plate.

9. The air conditioner according to claim 8, wherein the rib protrudes from the receiving plate.

10. The air conditioner according to claim 8, wherein the guide part is connected to the rib to guide the dew formed on the panel part to the receiving plate.

11. The air conditioner according to claim 8, wherein the rib is formed integrally with the partition member.

12. The air conditioner according to claim 8, wherein the receiving plate is disposed to be in communication with the drain panel.

13. The air conditioner according to claim 8, wherein the blocking member is disposed such that dew is formed on one surface of the panel part facing the partition member and guided to the receiving plate.

14. An air conditioner comprising:

a cabinet comprising an inlet port;

a frame coupled to the cabinet, the frame comprising:

a discharge panel having a first outlet port; and a second outlet port provided adjacent to the discharge panel;

a heat exchanger disposed between the cabinet and the frame to exchange heat with air introduced into the inlet port and discharged heat-exchanged air to the first outlet port and the second outlet port, respectively; and a blocking member configured to connect the frame and the heat exchanger to prevent the heat-exchanged air from leaking into the cabinet, wherein the blocking member is configured to guide the heat-exchanged air to the first outlet port and prevent the heat-exchanged air from flowing to the second outlet port.

* * * * *